US006435581B1

(12) United States Patent
House et al.

(10) Patent No.: US 6,435,581 B1
(45) Date of Patent: Aug. 20, 2002

(54) THREE-YARD CONCRETE BUCKET WITH INTEGRAL LADDER

(76) Inventors: James L. House; David James House, both of P.O. Box 370, Frisco City, AL (US) 36445

( * ) Notice: Subject to any disclaimer, the term of this patent is extended or adjusted under 35 U.S.C. 154(b) by 20 days.

(21) Appl. No.: 09/783,271

(22) Filed: Feb. 13, 2001

(51) Int. Cl.[7] ..... B66F 9/00; E04G 21/04; B28C 7/04

(52) U.S. Cl. ..... 294/68.1; 294/68.22; 366/42

(58) Field of Search ..... 366/41, 39, 42, 366/189; 414/683; 294/68.1, 68.25, 68.24, 68.23, 68.22; 222/185.1

(56) References Cited

U.S. PATENT DOCUMENTS

| | | | | | |
|---|---|---|---|---|---|
| 642,171 | A | | 1/1900 | Suppes | 294/68.1 |
| 737,449 | A | * | 8/1903 | McElhany | 294/68.22 |
| 1,005,138 | A | * | 10/1911 | Bartlett | 294/68.22 |
| 1,561,917 | A | * | 11/1925 | Farnsworth et al. | 294/68.25 |
| 1,774,793 | A | * | 9/1930 | Egan | 294/68.22 |
| 1,875,174 | A | * | 8/1932 | McGivern | 294/68.25 |
| 2,054,546 | A | * | 9/1936 | Kerstling | 294/68.22 |
| 2,179,428 | A | * | 11/1939 | Schiavi | 294/68.22 |
| 2,217,283 | A | * | 10/1940 | Lorrin | 294/68.22 |
| 2,812,970 | A | * | 11/1957 | Martinson | 294/68.24 |
| 2,901,148 | A | | 8/1959 | Cunningham et al. | 222/185.1 |
| 2,956,833 | A | * | 10/1960 | Morbin | 294/68.25 |
| 3,146,924 | A | | 9/1964 | Cozadd et al. | 222/503 |
| 3,257,102 | A | * | 6/1966 | Zimmerman | 366/12 |
| 3,371,939 | A | * | 3/1968 | Welk | |
| 3,414,312 | A | * | 12/1968 | Garlinghouse | 294/68.24 |
| 3,787,084 | A | * | 1/1974 | Garlinghouse | 294/68.22 |
| 3,866,887 | A | * | 2/1975 | Potter | 366/22 |
| D251,916 | S | * | 5/1979 | Gendron et al. | D23/202 |
| 4,432,578 | A | | 2/1984 | Garlinghouse | 294/68.21 |
| 4,539,104 | A | | 9/1985 | Jackson | 209/172.5 |
| 4,798,510 | A | | 1/1989 | Lazenby | 416/607 |
| 5,339,996 | A | * | 8/1994 | Dubbert et al. | 222/185.1 |
| 5,649,377 | A | | 7/1997 | Tanada | 37/406 |
| 5,741,065 | A | | 4/1998 | Bell et al. | 366/54 |
| 5,829,949 | A | | 11/1998 | Brown | 414/725 |
| 6,039,468 | A | | 3/2000 | Kowalcyzk | 366/41 |

* cited by examiner

*Primary Examiner*—Tony G. Soohoo
(74) *Attorney, Agent, or Firm*—John D. Gugliotta

(57) ABSTRACT

A three-yard concrete bucket with integral ladder is provided which comprises a series of steps attached by welding to the exterior perimeter of the bucket. When attached, a worker can easily inspect the inside of the bucket, clean the bucket, or enter the interior of the bucket. No external ladders or devices are needed.

6 Claims, 3 Drawing Sheets

THREE-YARD CONCRETE BUCKET WITH INTEGRAL LADDER

RELATED APPLICATIONS

The present invention was first described in Disclosure Document No. 476,333 filed on Jul. 3, 2000. There are no previously filed, nor currently any co-pending applications, anywhere in the world.

BACKGROUND OF THE INVENTION

1. Field of the Invention

The present invention relates generally to a concrete bucket for holding and dispensing concrete mixtures and, more particularly, to a three-yard concrete bucket with integral ladder.

2. Description of the Related Art

Many construction projects that utilize concrete occur at high elevations above grade. These projects include high-rise buildings, bridges, roofs, and the like. While many locations are able to utilize concrete pumping trucks which employ hydraulic pumping, a vast majority of such projects still utilize portable buckets that are lifted by overhead crane. One of the most common of these sizes is the three-yard bucket. While these buckets can transport a large amount of wet concrete, their large size also makes it difficult when accessing the interior of the bucket. Such access is often needed when inspecting the bucket, cleaning the bucket, or simply getting inside the bucket. Many times construction workers will use a separate ladder which takes time to set up. Other times they may just climb on the exterior of the bucket, which it is not meant to do, thus compromising safety.

Accordingly, there exists a need for a means by which access to the interior of three-yard concrete buckets can be provided in an easy and quick manner. The development of the three-yard concrete bucket with integral ladder fulfills this need.

A search of the prior art did not disclose any patents that read directly on the claims of the instant invention; however, the following references were considered related. The following patents describe a washout assembly for a cement mixer vehicle: U.S. Pat. No. 6,039,468 issued in the name of Kowalcyzk; and U.S. Pat. No. 5,741,065 issued in the name of Bell et al.

The following patents describe a dispensing bucket removably connected to a loader vehicle: U.S. Pat. No. 5,829,949 issued in the name of Brown; and U.S. Pat. No. 4,798,510 issued in the name of Lazenby.

The following patents disclose an elevator bucket with a guard extension: U.S. Pat. No. 4,539,104 issued in the name of Jackson; and U.S. Pat. No. 642,171 issued in the name of Suppes.

U.S. Pat. No. 5,649,377 issued in the name of Tanada describes a multipurpose bucket structure for construction purposes.

U.S. Pat. No. 4,432,578 issued in the name of Garlinghouse discloses a closed pressure actuated system for a placement bucket.

U.S. Pat. No. 3,148,924 issued in the name of Habler describes a tray stand with a detachable receptacle mounted on the legs.

U.S. Pat. No. 2,901,148 issued in the name of Cunningham discloses a bucket for conveying concrete.

Consequently, a need has been felt for providing a means for construction workers who must work with concrete buckets a means to access them more quickly and easily, while improving safety as well.

SUMMARY OF THE INVENTION

Therefore, it is an object of the present invention to provide a concrete bucket ladder which provides a means to access the interior of large concrete buckets.

It is another object of the present invention to provide a concrete bucket ladder which is used with concrete buckets that are lifted by crane.

It is still another object of the present invention to provide a concrete bucket ladder which can be used when inspecting a bucket interior.

It is still another object of the present invention to provide a concrete bucket ladder which aids in cleaning the bucket interior.

It is another object of the present invention to provide a concrete bucket ladder which allows a worker to climb inside the interior of the bucket more easily.

It is another object of the present invention to provide a concrete bucket ladder which is great for any contractor who regularly works with concrete.

It is another object of the present invention to provide a concrete bucket ladder which is ideal for inspection and safety purposes.

It is another object of the present invention to provide a concrete bucket ladder which reduces business costs and saves time.

It is another object of the present invention to provide a concrete bucket ladder which saves the cost of a separate ladder.

Briefly described according to one embodiment of the present invention, a three-yard concrete bucket with integral ladder is provided which comprises a series of steps attached by welding to the exterior perimeter of the bucket. When attached, a worker can easily inspect the inside of the bucket, clean the bucket, or enter the interior of the bucket. No external ladders or devices are needed. The invention also provides attached eye hooks to which safety lanyards may be attached to comply with any applicable safety regulations.

The use of the present invention provides a means for construction workers who must work with concrete buckets a means to access them more quickly and easily, while improving safety as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
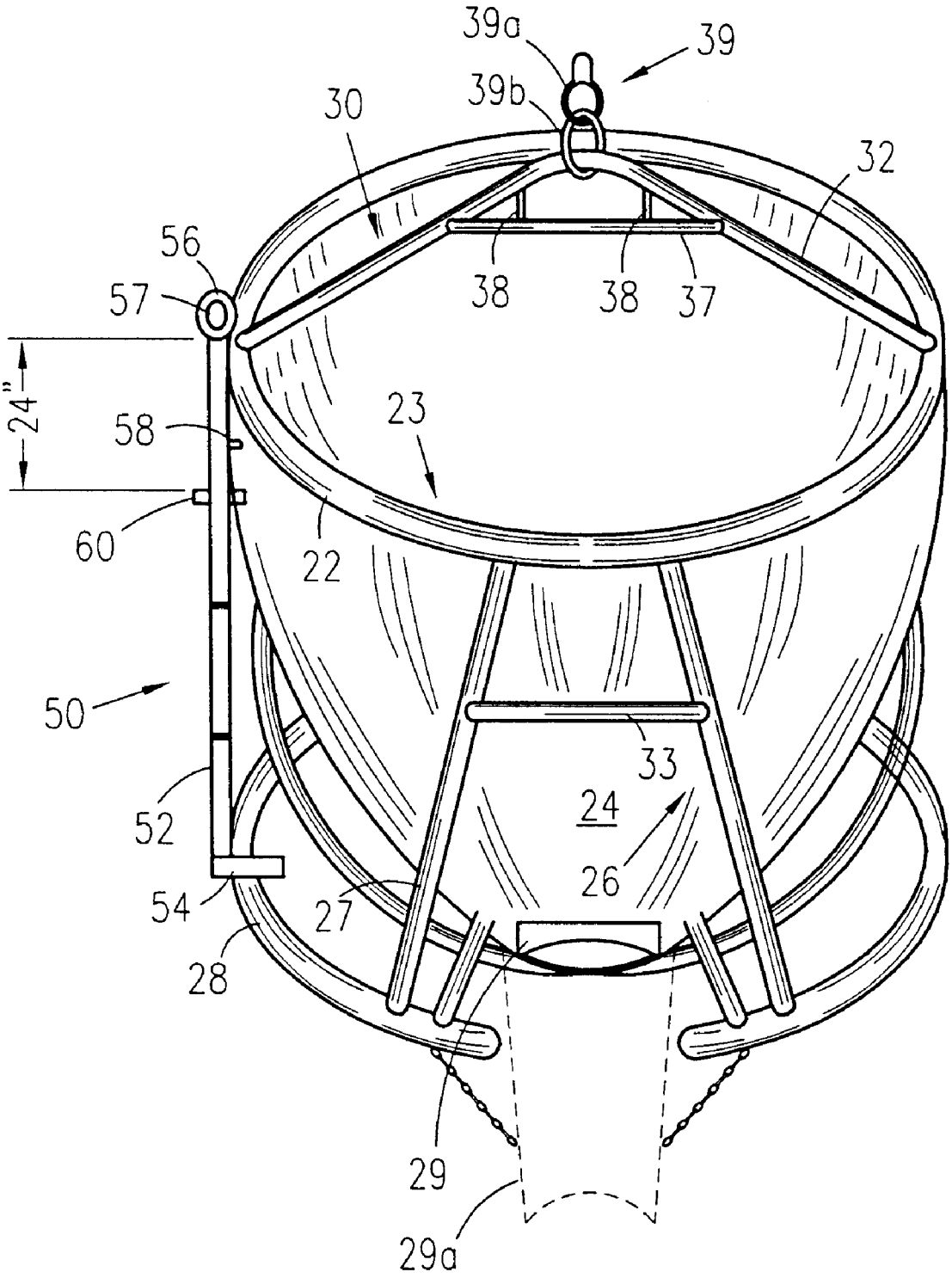
FIG. 1 is a perspective view of a three-yard concrete bucket with integral ladder according to the preferred embodiment of the present invention.
Figure 2:
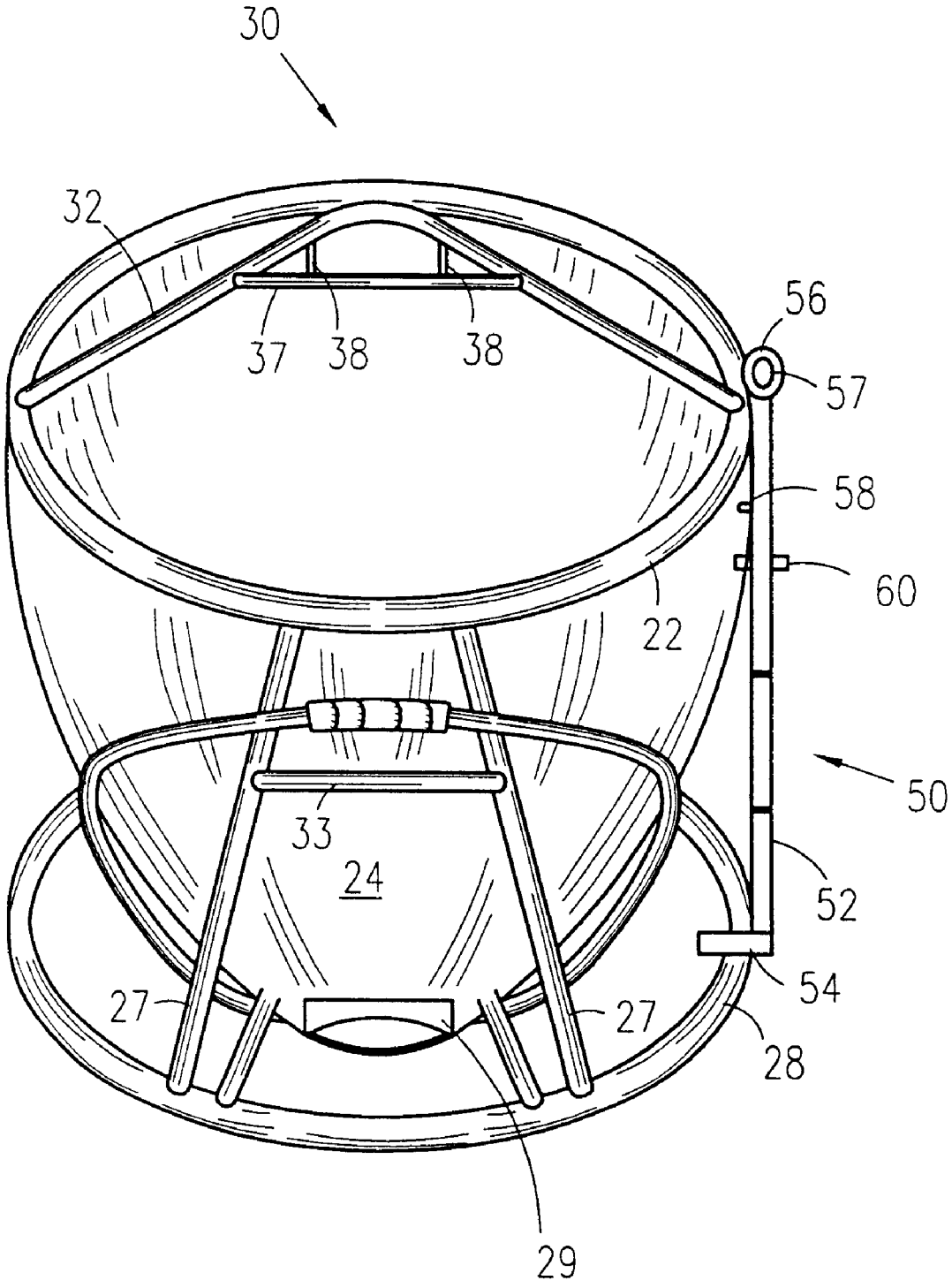
FIG. 2 is a side elevational view of the three-yard concrete bucket with integral ladder shown without the hoist apparatus according to the preferred embodiment of the present invention.
Figure 3:
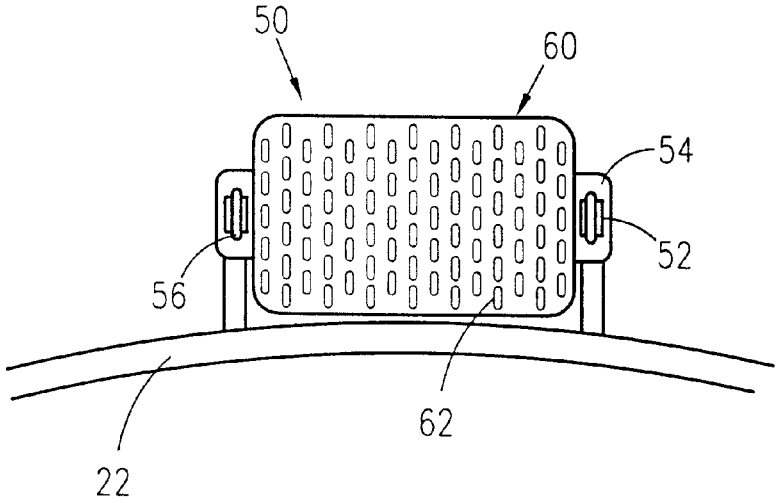
FIG. 3 is a top plan view of the ladder according to the preferred embodiment of the present invention.
Figure 4:
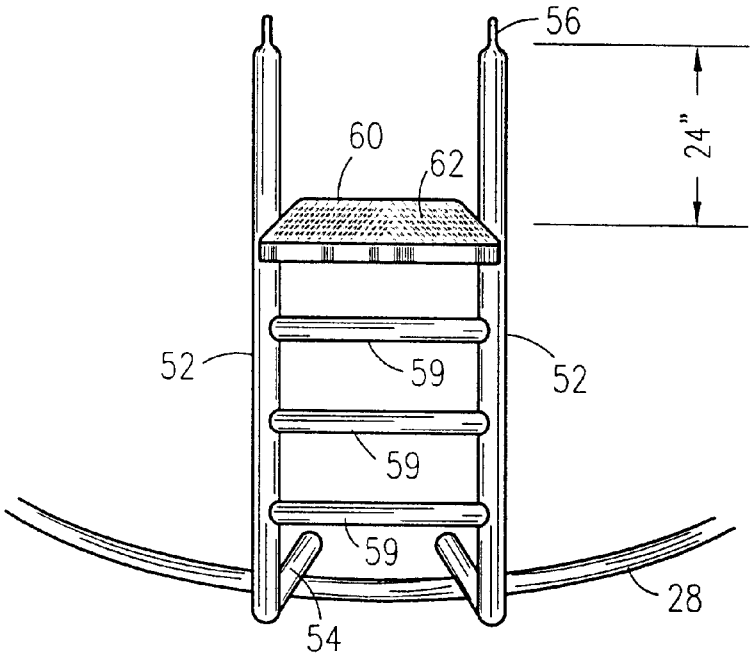
FIG. 4 is a rear side view of the ladder according to the preferred embodiment of the present invention.

Referring now to FIGS. 1–4, a three-yard concrete bucket with integral ladder 10 is shown, according to the present invention, comprised of a three-yard concrete bucket 20 with an integral ladder 50 for allowing easy access to an interior of the bucket 20.

The bucket 20 includes a rim 22 adjoined to a conical hopper portion 24 extending about the perimeter of an open upper section 23 thereof, a pair of skirt supporting structures 26, a base ring 28, a lower funneled section 29, and a hoist bail assembly 30. The rim 22 and the base ring 28 are fabricated of steel tubing having a diameter measuring approximately 2½ inches. A portion of the base ring 28 is left open forming a void 28*a* therein so as to facilitate mating of a chute 29*a* with the lowered funnel section 29*a*.

The hoist bail assembly 30 includes an A-shaped tubular structure comprised of a linearly elongated, V-shaped hoist member 32 which forms an apex 35 and is welded at opposite ends thereof to upper external circumferential surfaces of the rim 22. The V-shaped hoist member 32 is fabricated of steel tubing having a diameter measuring approximately 3 inches.

Ends of a plurality of tubular support legs 38 are welded perpendicularly between a lower external circumferential surface of the V-shaped hoist member 32 and a linearly elongated, tubular cross member 37 which is welded to a lower external circumferential sidewall of the hoist member 32 in such a manner so as to form a pair of acute angles with respect therewith.

A hoist apparatus 39, comprised of a pair of circular, tubular steel loops 39*a*, 39*b* linked together, and connectively joined at the apex 35 of the V-shaped hoist member 32, is provided for facilitating a means for hoisting, suspending, and lowering the bucket 20.

Each of the pair of skirt supporting structures 26 is of an H-shaped configuration welded at opposed locations along the base ring 28 and comprises a pair of linearly elongated, tubular legs 27 fabricated of steel and having a diameter measuring approximately 2½ inches. A horizontal tubular member 33 is welded perpendicularly between the tubular legs 27. Lower ends of each tubular leg 27 of each pair of skirt supporting structures 26 are welded to an outer circumferential sidewall of the base ring 28, and upper ends of each tubular leg 27 are welded to an external circumferential surface of the rim 22.

The ladder 50 comprises a pair of L-shaped vertical leg members 52 fabricated of tubular steel stock. A lower surface of each lower end 54 of each vertical leg member 52 is welded to an upper, outer circumferential sidewall of the base ring 28, lateral to each skirt supporting structure 26. Upper ends of each vertical leg member 52 are formed into eye hooks 56 defining holes 57 therethrough. An external surface of each eye hook 56 is welded to an external surface of the rim 22 of the bucket 20. The eye hooks 56 provide a means for easily attaching safety lanyards thereto so as to comply with applicable safety regulations.

Each of a pair of linearly elongated, rectangular support arms 58 are welded between an outer surface of each vertical leg member 52, just below the eye hooks 56, and the external surface of the conical hopper portion 24, so as to provide structural stability to the ladder 50.

A series of linearly elongated, tubular steps 59 fabricated of steel stock are welded perpendicularly between inside external circumferential surfaces of the vertical leg members 52.

A top step 60, generally of a flat, rectangular configuration having a grated upper surface 62 and a width measuring approximately 4 inches, is welded between inside external circumferential surfaces of the vertical leg members 52, at a measured distance of approximately two feet below the rim 22 of the bucket 20. The ladder 50 provides a climbing means for gaining access to an interior of the bucket 20 so as to allow the bucket 20 to be cleaned and chipped out by the user. The location of the top step 60, namely positioned approximately two feet below the rim 22 of the bucket 20, is of critical importance to the present invention. When cleaning and chipping out the interior of the bucket 20, the user is required to lean over the open upper section 23. Thus, standing at an excessive height leads to improper and excessive leaning by the user into the bucket 20, thereby creating both an unstable and unsafe working condition.

The grated upper surface 62 of the top step 60 provides a non-skid platform for preventing inadvertent slippage of feet of the user thereon when cleaning and chipping out the bucket 20. The design and configuration of the top step 60 as disclosed herein provides the user with both a stable and safe climbing means.

2. Operation of the Preferred Embodiment

To use the present invention, the user attaches safety lanyards to the eye hooks 56 so as to comply with applicable safety regulations, and then simply climbs the integral ladder 50 up to the grated top step 60 in order to gain access to the interior of the concrete bucket. While standing on the top step 60, which provides a nonskid platform, the user easily, quickly, and safely cleans and chips out the concrete bucket 20.

The use of the present invention provides a means for construction workers who must work with concrete buckets a means to access them more quickly and easily, while improving safety as well.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A concrete bucket comprising:

a three-yard concrete bucket including a rim adjoined to a conical hopper portion extending about the perimeter of an open upper section thereof, a pair of skirt supporting structures, a base ring, a lower funneled section, and a hoist bail assembly; and an integral ladder for allowing easy access to an interior of the bucket.

2. The concrete bucket of claim 1, wherein a portion of the base ring is left open forming a void therein so as to facilitate mating of a chute with the lowered funnel section.

3. The concrete bucket of claim 2, further comprising a hoist bail assembly having an A-shaped tubular structure comprised of a linearly elongated, V-shaped hoist member which forms an apex and is affixed at opposite ends thereof to upper external circumferential surfaces of the rim.

4. The concrete bucket of claim 3, further comprising a plurality of support legs having ends affixed perpendicularly between a lower external circumferential surface of the V-shaped hoist member and a linearly elongated, tubular cross member which is welded to a lower external circumferential sidewall of the hoist member in such a manner so as to form a pair of acute angles with respect therewith.

5. The concrete bucket of claim 4, further comprising a hoist apparatus provided for facilitating a means for hoisting, suspending, and lowering the bucket and comprised of a pair of circular, tubular steel loops linked together, and connectively joined at the apex of the V-shaped hoist member.

6. The concrete bucket of claim 5, wherein said ladder comprises a pair of L-shaped vertical leg members and a series of linearly elongated, tubular steps affixed perpendicularly between inside external circumferential surfaces of the vertical leg members.

* * * * *